US011181306B2

(12) United States Patent
Zhang et al.

(10) Patent No.: US 11,181,306 B2
(45) Date of Patent: Nov. 23, 2021

(54) DOUBLE-SIDED ROLL BOND CONDENSER, DOUBLE-SIDED ROLL BOND CONDENSER EMBEDDING STRUCTURE, AND EMBEDDING METHOD THEREOF

(71) Applicant: Cooler Master Co., Ltd., New Taipei (TW)

(72) Inventors: Xiong Zhang, New Taipei (TW); Jie Zhou, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 54 days.

(21) Appl. No.: 16/235,626

(22) Filed: Dec. 28, 2018

(65) Prior Publication Data

US 2019/0212039 A1 Jul. 11, 2019

(30) Foreign Application Priority Data

Jan. 9, 2018 (CN) ..... 201810018078.4

(51) Int. Cl.

| | |
|---|---|
| ***F25B 39/04*** | (2006.01) |
| ***B21D 22/00*** | (2006.01) |
| ***F28D 21/00*** | (2006.01) |
| ***B21D 22/02*** | (2006.01) |

(52) U.S. Cl.

CPC ..... *F25B 39/04* (2013.01); *B21D 22/00* (2013.01); *B21D 22/025* (2013.01); *F25B 2339/043* (2013.01); *F28D 2021/0063* (2013.01)

(58) Field of Classification Search

CPC ..... B21D 22/00; B21D 22/025; B21D 39/00; F25B 39/04; F25B 2339/043; F28D 2021/0063; F28D 15/00; F28F 9/0075; F28F 2275/10; F28F 2215/06; F28F 3/14; F28F 9/262

See application file for complete search history.

(56) References Cited

U.S. PATENT DOCUMENTS

| | | | | |
|---|---|---|---|---|
| 6,120,265 | A | 9/2000 | Wu | |
| 6,640,582 | B2 * | 11/2003 | Incorvia | F25B 39/04 210/287 |
| 2002/0083732 | A1 * | 7/2002 | Incorvia | F25B 39/04 62/474 |
| 2002/0174676 | A1 * | 11/2002 | Incorvia | F25B 43/003 62/474 |
| 2007/0221056 | A1 | 9/2007 | Kutella | |

(Continued)

FOREIGN PATENT DOCUMENTS

| | | | |
|---|---|---|---|
| CN | 105101751 | A | 11/2015 |
| TW | I472292 | B | 2/2015 |
| TW | M568350 | U | 10/2018 |

*Primary Examiner* — Ljiljana V. Ciric

(74) *Attorney, Agent, or Firm* — Bradley J. Thorson; DeWitt LLP

(57) ABSTRACT

A double-sided roll bond condenser has a main body, an interposition section, and a neck portion. The main body is an upright board and has two side surfaces. Two filling structures are respectively protruded from the two side surfaces of the main body. The interposition section is formed at a bottom portion of the double-side roll bond condenser, and is a U-shaped folded structure. The U-shaped folded structure protrudes from one of the two side surfaces of the main body. The neck portion is located between the main body and the interposition section.

17 Claims, 20 Drawing Sheets

(56) References Cited

U.S. PATENT DOCUMENTS

2013/0340978 A1* 12/2013 Agostini ..... F28D 15/0275
165/104.21
2015/0337821 A1 11/2015 Fang et al.

* cited by examiner

DOUBLE-SIDED ROLL BOND CONDENSER, DOUBLE-SIDED ROLL BOND CONDENSER EMBEDDING STRUCTURE, AND EMBEDDING METHOD THEREOF

BACKGROUND OF THE INVENTION

1. Field of the Invention

The present invention relates to a roll bond condenser, more particularly to a double-sided roll bond condenser, a double-sided roll bond condenser embedding structure, and an embedding method thereof.

2. Description of Related Art

A cold embedding method is to embed the roll bond condenser on a base having plurality of slots by mechanical pressing. With reference to FIGS. 14 to 20, the one-sided roll bond condenser 2 has two surfaces. One of the two surfaces of the one-sided roll bond condenser 2 forms a filling pipe. The other surface of the one-sided roll bond condenser is flat. The bottom portion of the one-sided roll bond condenser 2 forms an interposition section 32, and the interposition section 32 is mounted in a slot 11. The interposition section 32 has a U-shaped folded structure. The cold embedding method is to use an embedding die 4 to compress the U-shaped folded structure of the interposition section 32, and this makes the interposition section 32 deform and be mounted in the slot 11. With reference to FIG. 20, the conventional one-sided roll bond condenser 2 has fewer medium compared with a double-sided roll bond condenser. Therefore, the conventional one-sided roll bond condenser 2 cannot meet the heat dissipation requirements of high power devices. A double-sided roll bond condenser is provided accordingly. The structure of the double-sided roll bond condenser is similar to that of the one-sided roll bond condenser, the difference being that the double-sided roll bond condenser has filling pipes on two sides thereof. However, the interposition section is blocked by the tubes in the direction of the top view, so the embedding die cannot compress the folded structure.

To overcome the shortcomings of the conventional one-sided roll bond condenser, the present invention provides a double-sided roll bond condenser to mitigate or obviate the aforementioned problems.

SUMMARY OF THE INVENTION

The main objective of the present invention is to provide a double-sided roll bond condenser, a double-sided roll bond condenser embedding structure, and an embedding method thereof.

The double-sided roll bond condenser has a main body, an interposition section, and a neck portion. The main body has two side surfaces. Two filling structures are respectively protruded from the two side surfaces of the main body. The interposition section is formed at a bottom portion of the double-sided roll bond condenser, and is a U-shaped folded structure. The U-shaped folded structure protrudes from one of the two side surfaces of the main body. The neck portion is located between the main body and the interposition section.

The double-sided roll bond condenser embedding structure has multiple double-sided roll bond condensers. Each double-sided roll bond condenser has a main body, an interposition section, and a neck portion. The main body has two side surfaces and two filling structures respectively formed at the two side surfaces of the main body. The interposition section is located a bottom portion of the double-sided roll bond condenser and is a U-shaped folded structure. The neck portion is located between the main body and the interposition section and has a curved structure. The base has multiple mounting slots formed in a top surface of the base, and the multiple mounting slots are parallel to each other. The interposition sections of the multiple double-sided roll bond condensers are respectively inserted into the mounting slots of the base.

The embedding method for a double-sided roll bond condenser, the embedding method has a first step, wherein a base is provided, and the base has multiple mounting slots formed in a top surface of the base;

a second step, wherein multiple double-side roll bond condensers are provided, each double-side roll bond condenser has a main body, an interposition section, and a neck portion, the interposition section is formed at a bottom portion of the double-side roll bond condenser and is a U-shaped folded structure, and the neck portion is located between the main body and the interposition section;

a third step, wherein each neck portion is stamped or bent to form a curved structure; and a fourth step, wherein each interposition section is pressed into a respective one of the mounting slots.

Other objects, advantages, and novel features of the invention will become more apparent from the following detailed description when taken in conjunction with the accompanying drawings.

DETAILED DESCRIPTION OF PREFERRED EMBODIMENT

Figure 1:
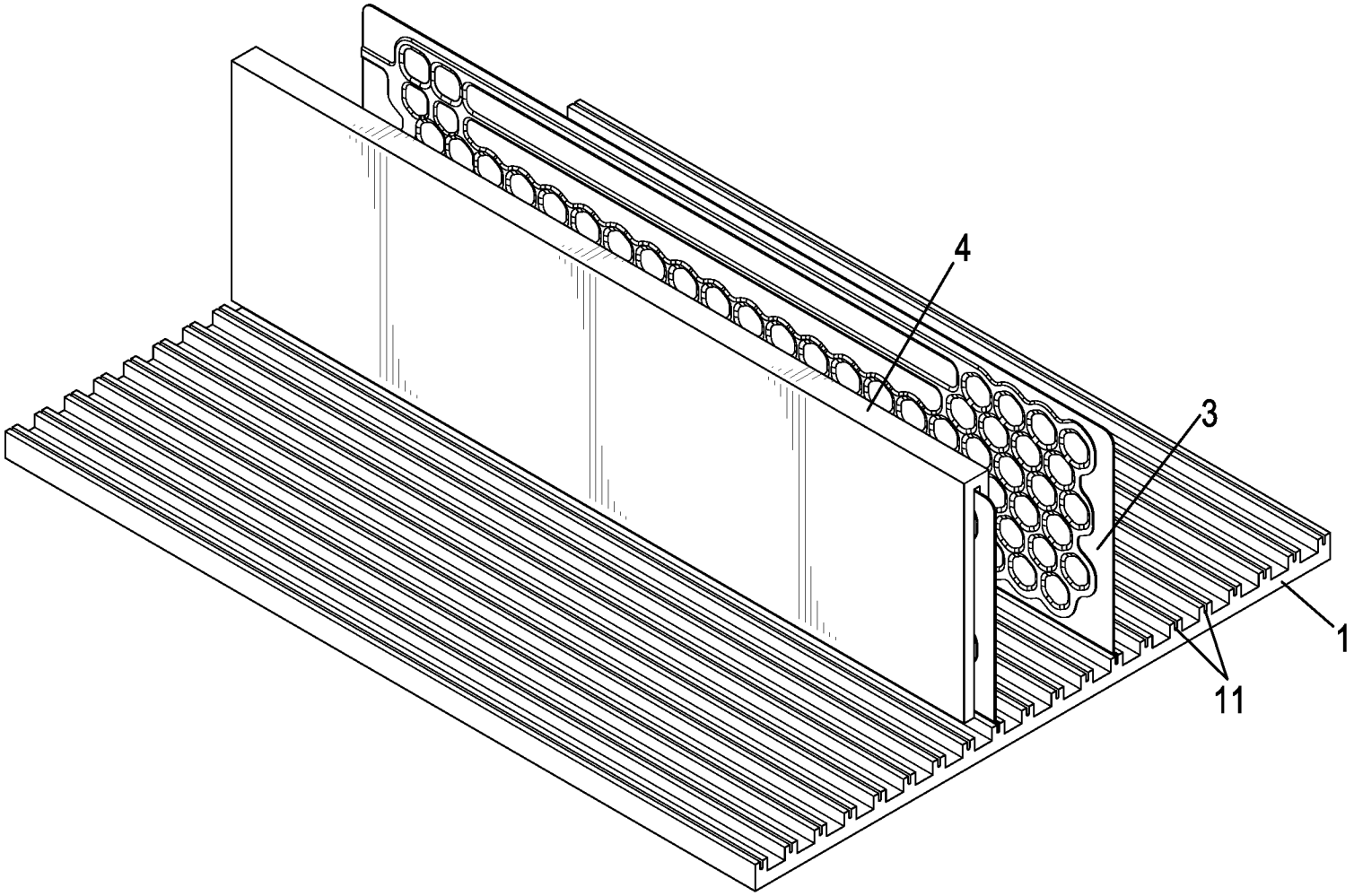
FIG. 1 is a perspective view of a double-sided roll bond condenser embedding structure in accordance with the present invention.
Figure 2:
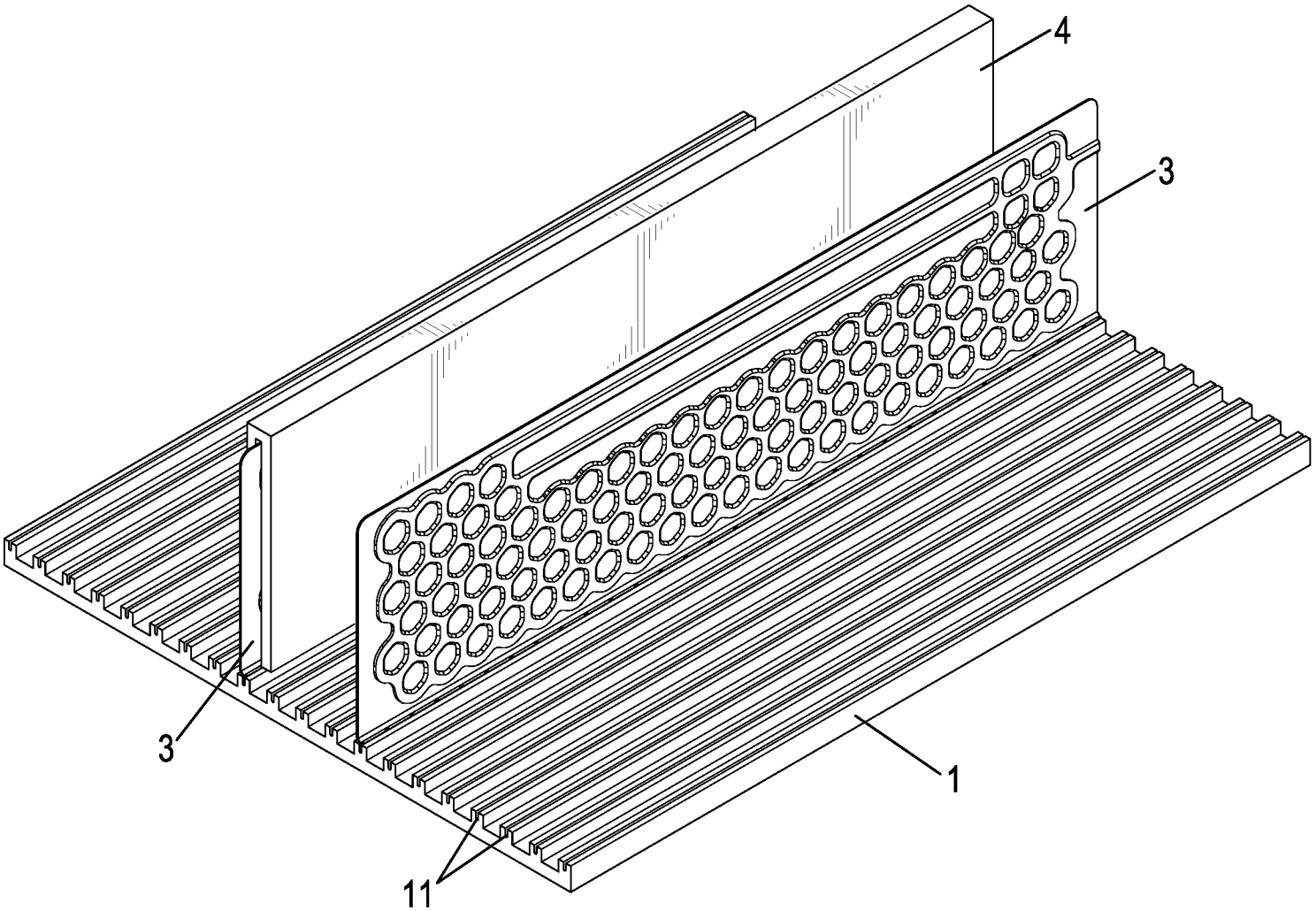
FIG. 2 is another perspective view of the double-sided roll bond condenser embedding structure in FIG. 1.
Figure 3:
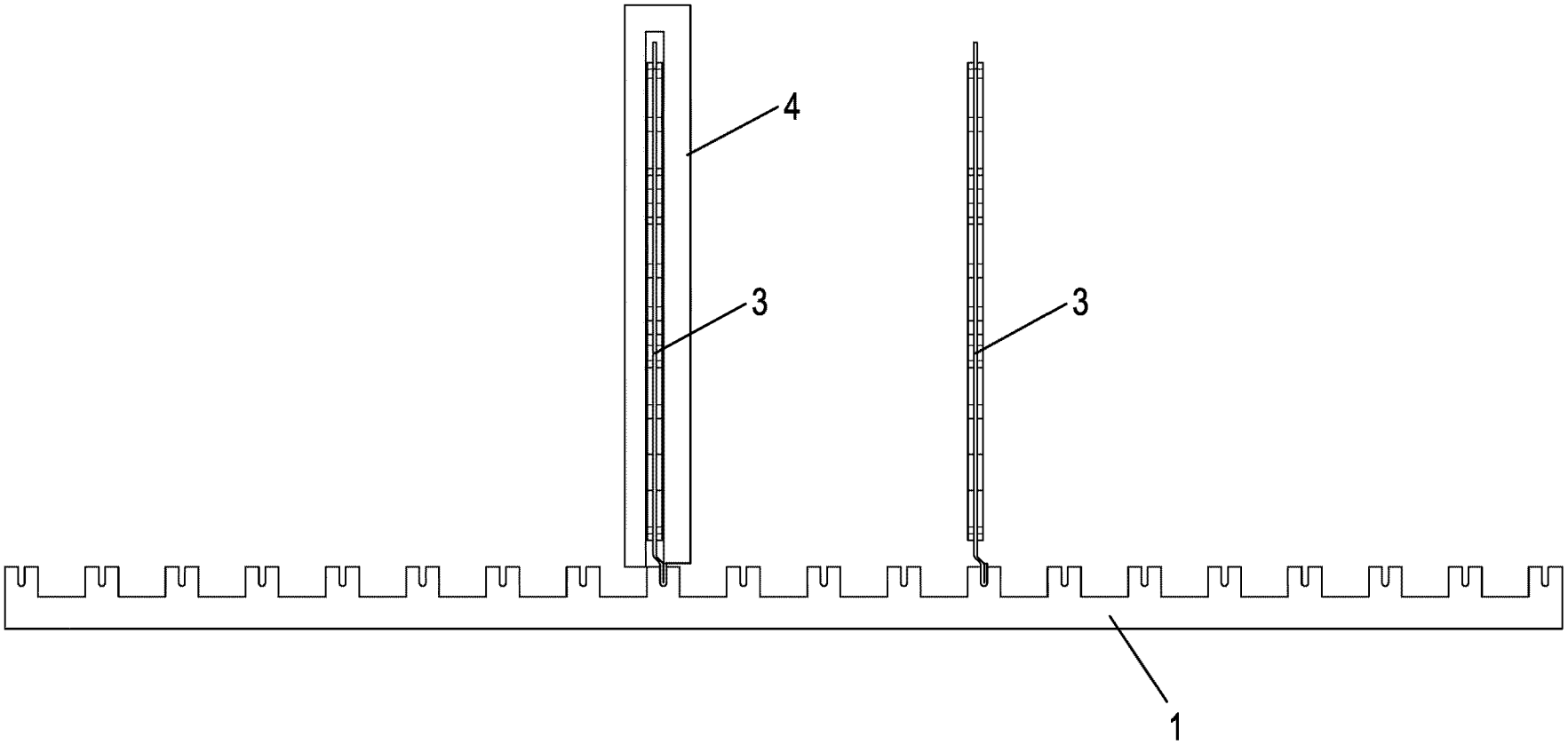
FIG. 3 is a front view of the double-sided roll bond condenser embedding structure in FIG. 1.
Figure 4:
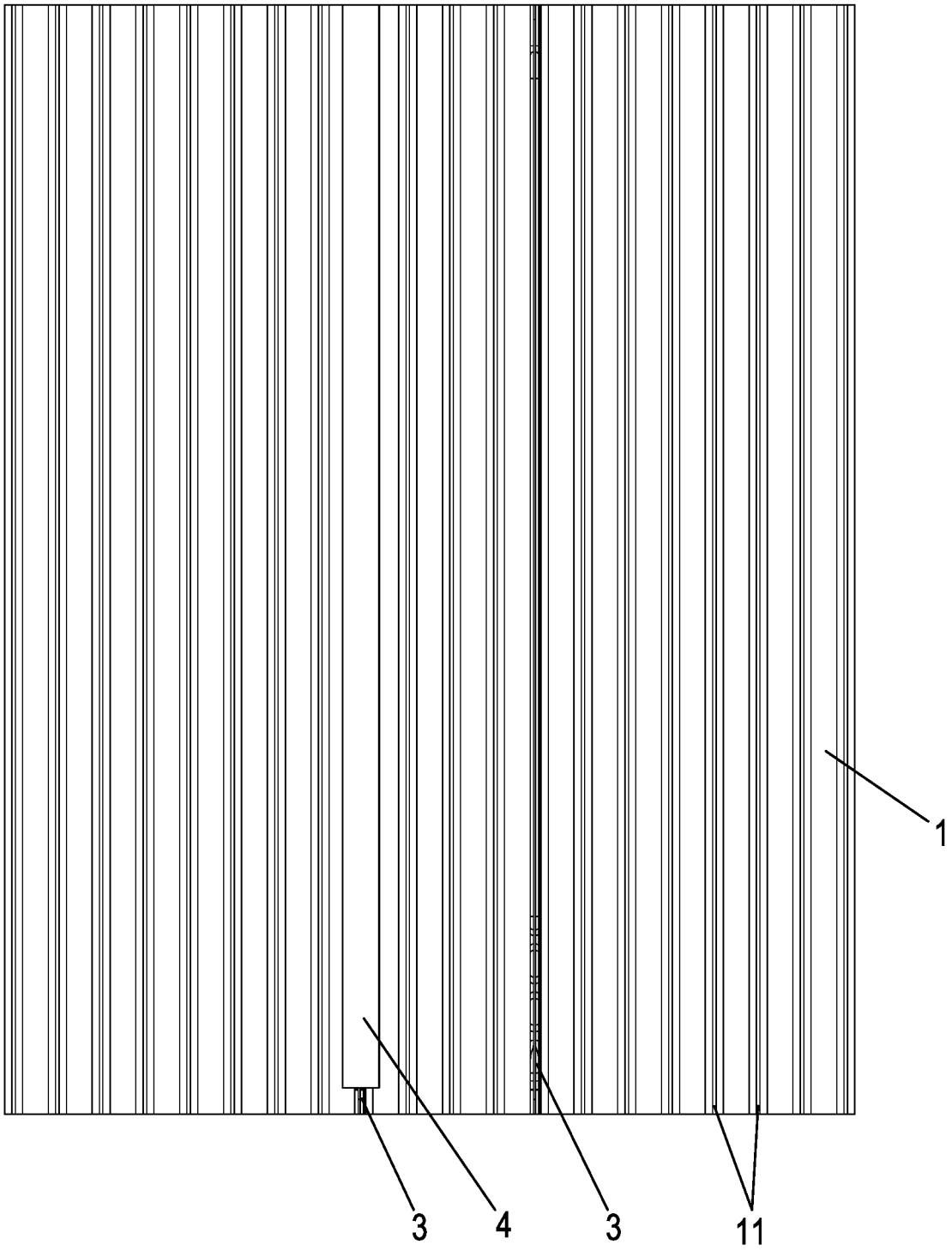
FIG. 4 is a top view of the double-sided roll bond condenser embedding structure in FIG. 1.

With reference to FIG. 1 to FIG. 7, a double-sided roll bond condenser 3 in accordance with the present invention comprises a main body 33, an interposition section 32, and a neck portion 31.

The main body 33 is an upright board and has two side surfaces. Two filling structures 331 are respectively formed on and protrude from the two side surfaces of the main body 33. Each filling structure 331 has multiple pipes, and each pipe is filled with a medium to improve heat dissipation. The interposition section 32 is formed at a bottom portion of the double-sided roll bond condenser 3, and is a U-shaped folded structure. The U-shaped folded structure extends toward one of the two side surfaces of the main body 33.

Figure 5:
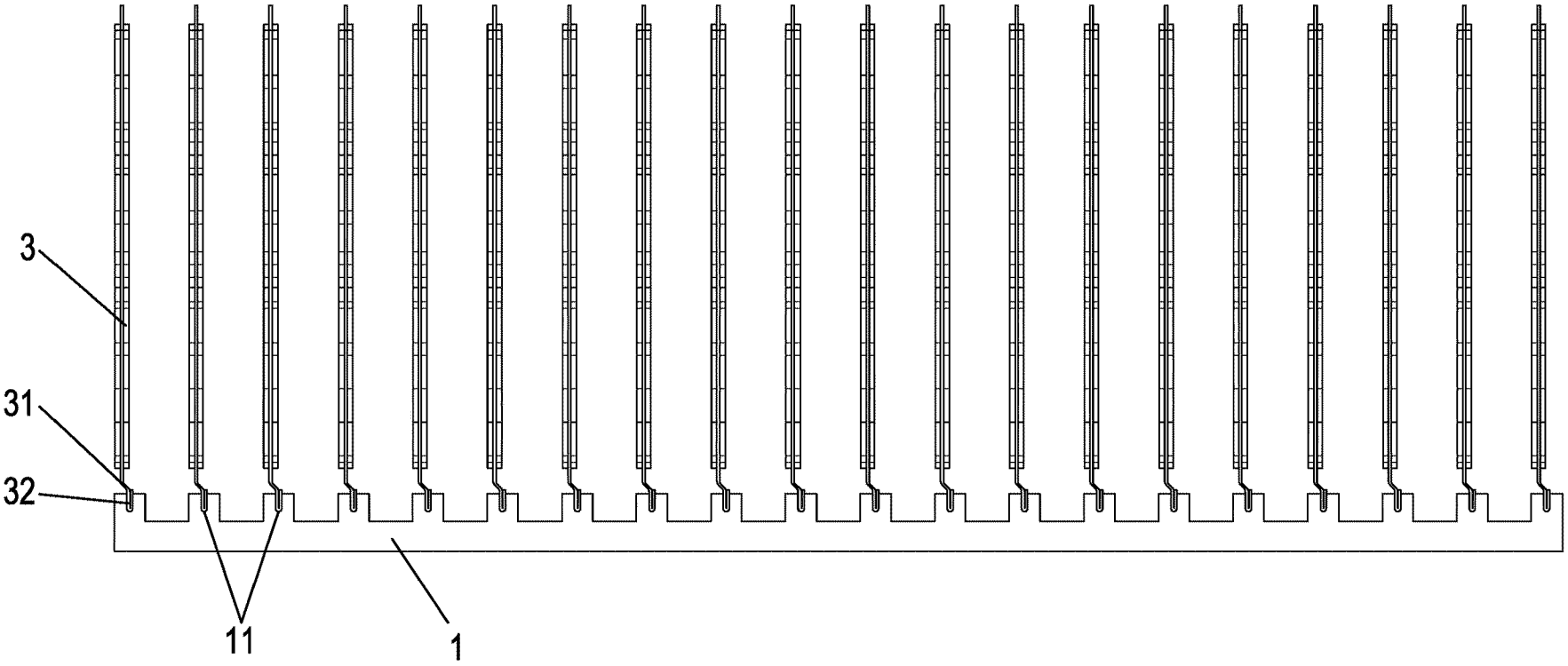
FIG. 5 is another front view of the double-sided roll bond condenser embedding structure.
Figure 6:
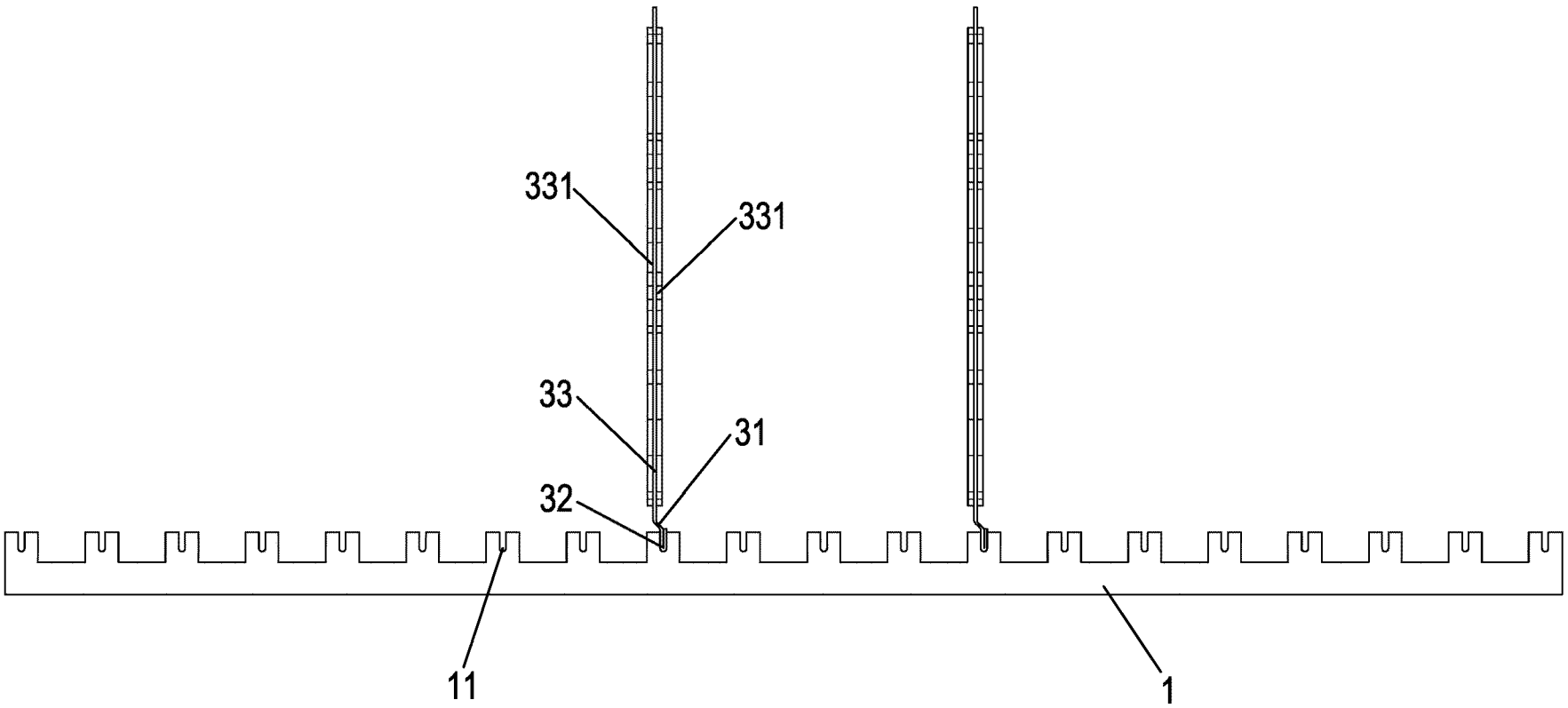
FIG. 6 is another front view of the double-sided roll bond condenser embedding structure in FIG. 1.
Figure 7:
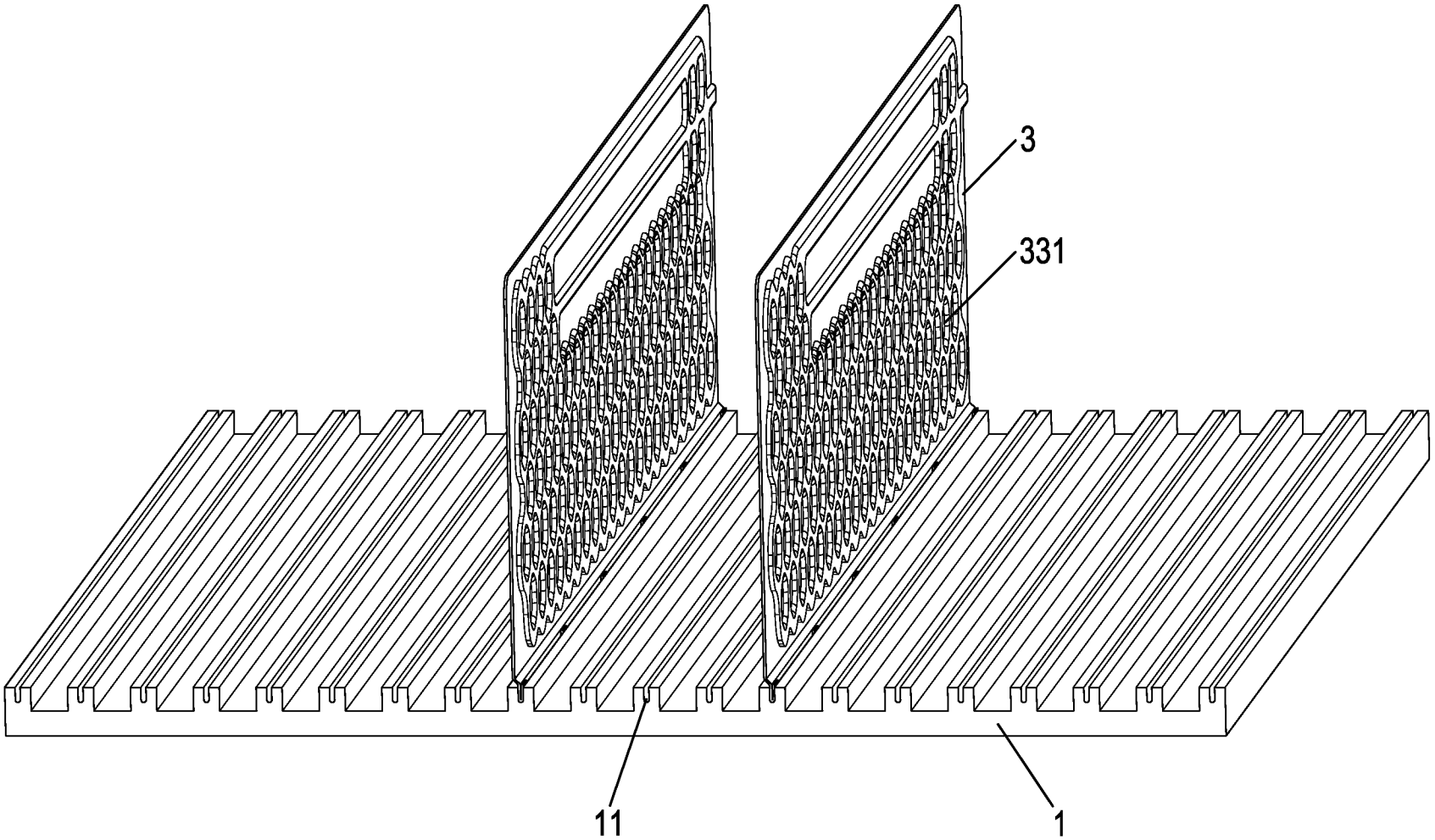
FIG. 7 is a perspective view of another embodiment of a double-sided roll bond condenser embedding structure in accordance with the present invention.
Figure 8:
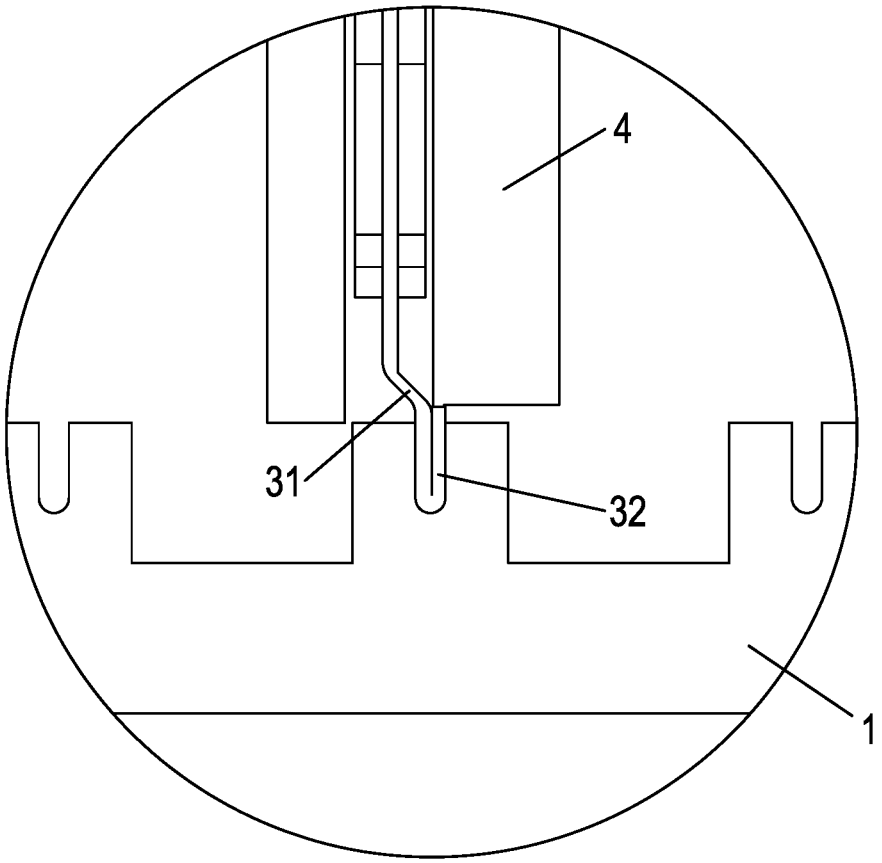
FIG. 8 is an enlarged front view of the double-sided roll bond condenser embedding structure in FIG. 1.

The neck portion 31 is located between the main body 33 and the interposition section 32. The neck portion 31 has a curved structure which is adjacent to an embedded position, wherein the embedded position is located at a top portion of the U-shaped folded structure. In this embodiment, the curved structure is bent toward a direction away from the embedded position. The curved structure may be arc-shaped. With reference to FIG. 5, the curved structure is bent toward a mounting slot 11.

With reference to FIGS. 1 to 9, the present invention also discloses a double-sided roll bond condenser embedding structure, and the double-sided roll bond condenser embedding structure has a base 1 and multiple double-sided roll bond condenser s 3. The base 1 is a board and has multiple mounting slots 11. The mounting slots 11 are parallel to each other. In this embodiment, the base 1 is made of copper, aluminum, copper-based alloy or aluminum-based alloy.

Figure 9:
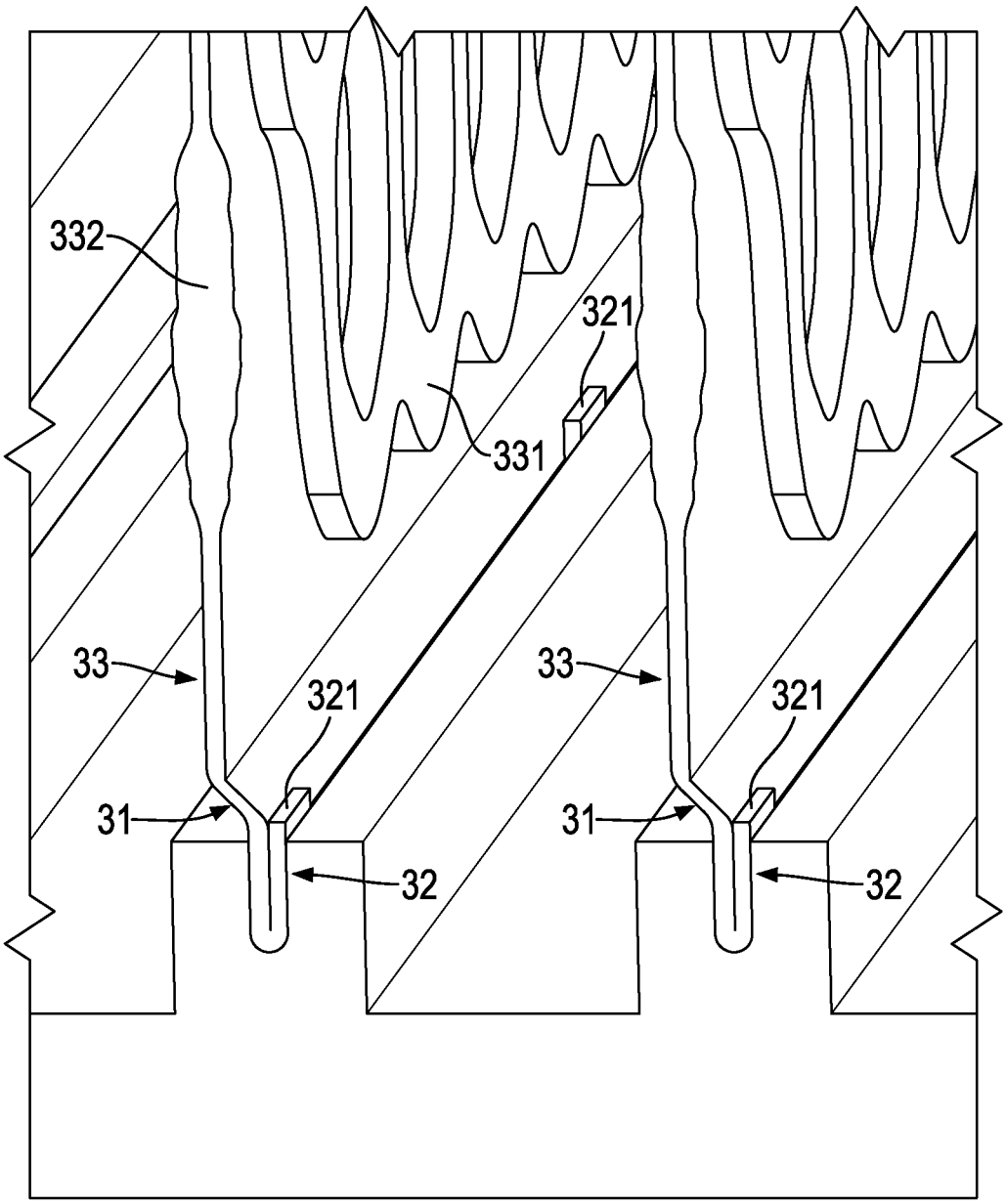
FIG. 9 is a perspective view of the double-sided roll bond condenser in accordance with the present invention.

The multiple double-sided roll bond condensers 3 are respectively mounted in the mounting slots 11 of the base 1. Each double-sided roll bond condenser 3 has a main body 33, an interposition section 32, and a neck portion 31. The main body 33 has two side surfaces. Two filling structures 331 are respectively formed on and protrude from the two side surfaces of the main body 33 and are filled with cooling medium. With reference to FIG. 9, each filling structures 331 on each roll bond condensers 3 has a sealing end 332 located on a front surface of the main body 33 to seal the filling structure 331 and to prevent the cooling medium in the filling structure from leaking. The interposition section 32 is formed at a bottom portion of the double-sided roll bond condenser 3, and is a U-shaped folded structure. The interposition section 32 has a first slice and a second slice. The interposition section 32 may have multiple protruding tabs 321. The protruding tabs 321 are formed on a top surface of the second slice of the interposition section 32 and protrude from the top surface of the corresponding mounting slot 11. The neck portion 31 is located between the main body 33 and the interposition section 32. The neck portion 31 is connected with the first slice of the interposition section 32. The neck portion 31 further has a curved structure. The curved structure is adjacent to the embedded position, and the curved structure is bent in a direction away from the embedded position. The multiple double-sided roll bond condensers 3 are inserted in the multiple mounting slots 11 by the interposition sections 32. In this embodiment, the curved structure is formed by using a stamping or bending machine. The curved structure is bent toward a mounting slot 11.

The curved structure is to prevent the filling structure 331 of the double-sided roll bond condenser 3 from blocking the embedded position. Specifically, the filling structure 331 of each double-sided roll bond condenser 3 is away from the embedded position in the direction of the top view, and this may avoid blocking the interposition section 32 of the double-sided roll bond condenser 3.

The bending degree of the curved structure can be set according to the deviation distance of the filling structure 331 of the double-sided roll bond condenser 3 from the embedded position in the vertical projection direction.

With reference to FIGS. 1 to 10, the invention also relates to the embedding method of the double-sided roll bond condenser 3, and the embedding method comprises the following steps:

Step 1, a base 1 is provided, the base 1 having multiple mounting slots 11 formed in a top surface of the base 1.

Step 2, multiple double-side roll bond condensers 3 are provided, each double-sided roll bond condenser 3 having a main body 33, an interposition section 32, and a neck portion 31. The interposition section 32 is formed at a bottom portion of the double-sided roll bond condenser 3, and is a U-shaped folded structure. The neck portion 31 is located between the main body 33 and the interposition section 32.

Step 3, the neck portion 31 is stamped or bent to form a curved structure.

Step 4, the interposition section 32 is pressed into the mounting slot 11 by an embedding tool 4 punching at the embedded position of the double-sided roll bond condenser 3.

Figure 10:
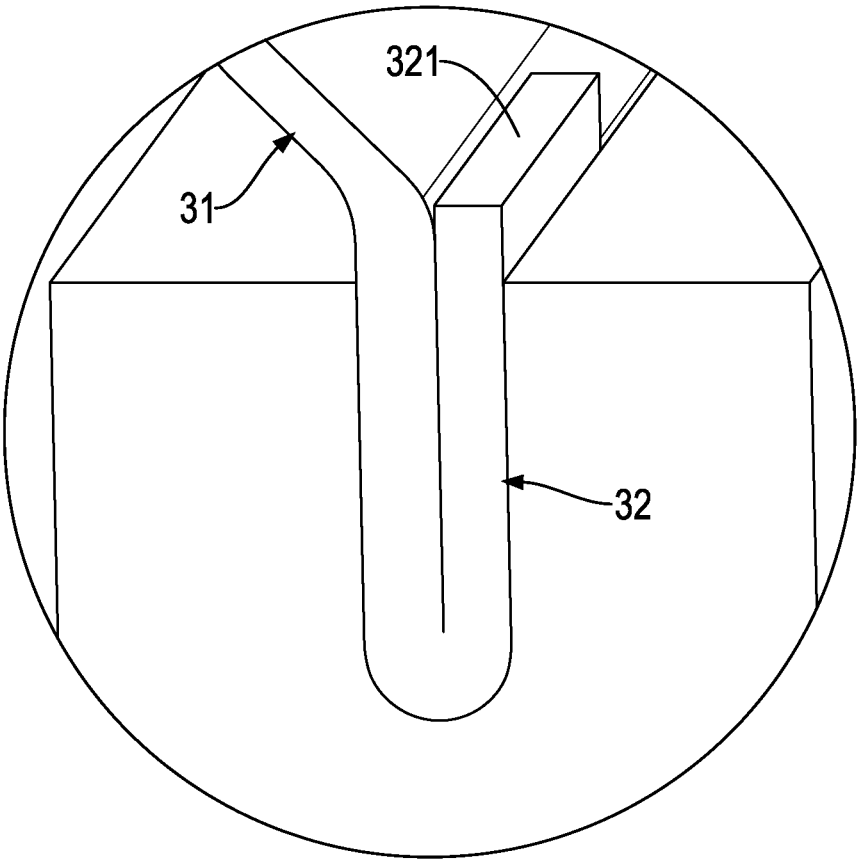
FIG. 10 is an enlarged perspective view of the double-sided roll bond condenser embedding structure in FIG. 9.
Figure 11:
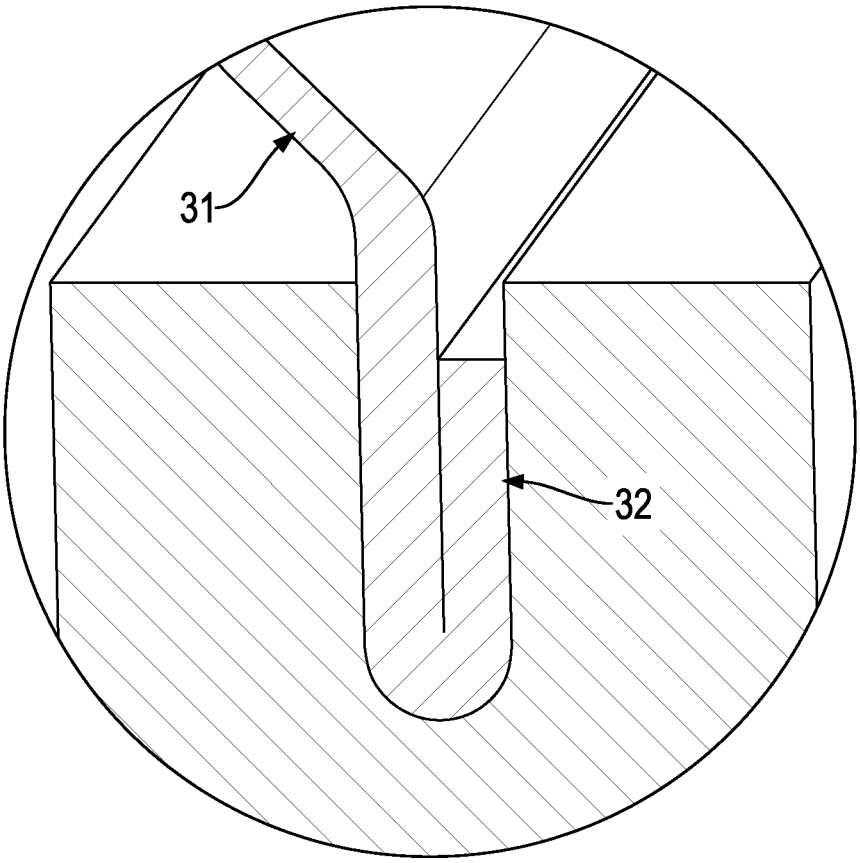
FIG. 11 is another enlarged cross sectional perspective view of the double-sided roll bond condenser embedding structure in FIG. 9.
Figure 12:
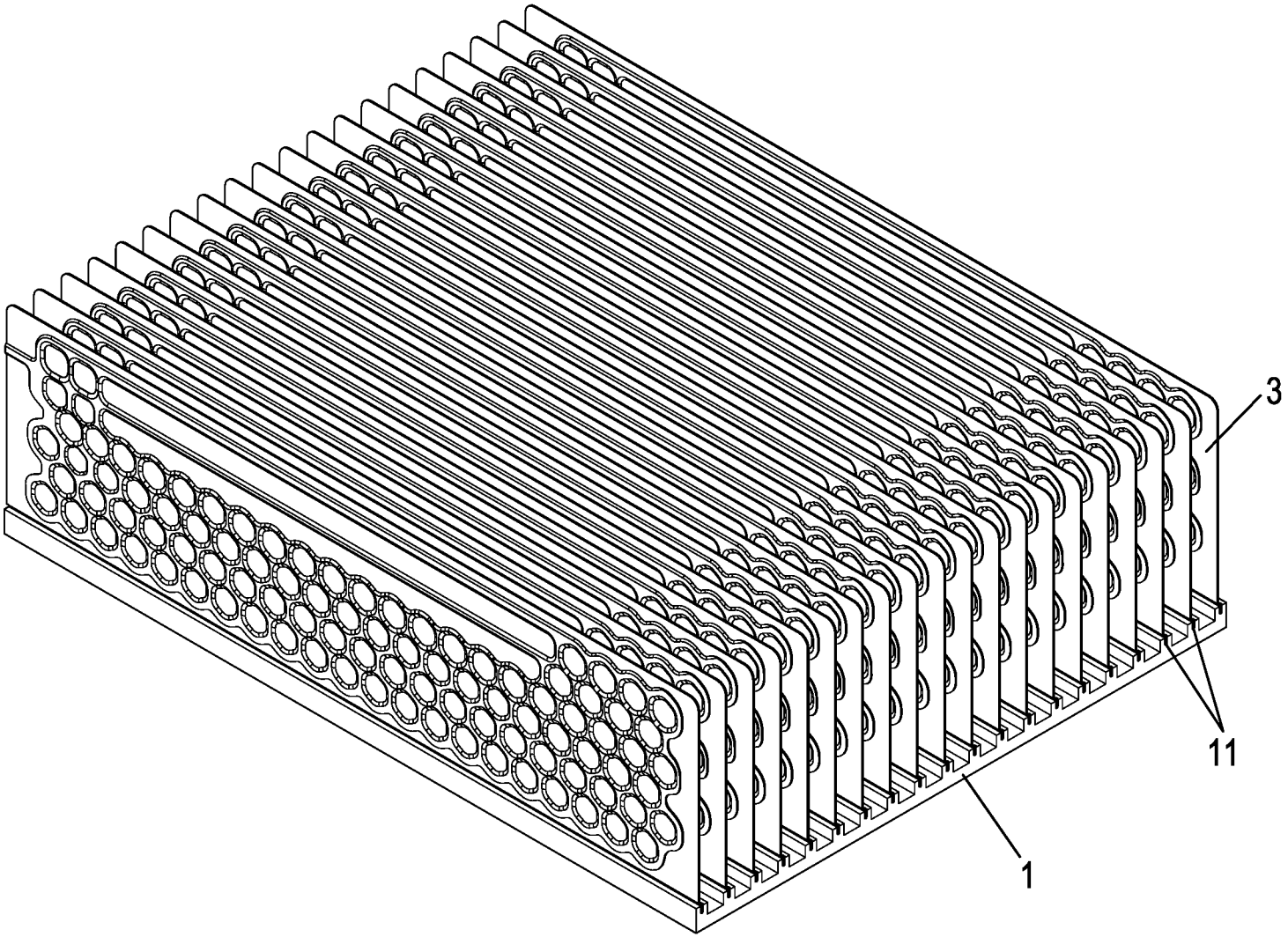
FIG. 12 is another perspective view of the double-sided roll bond condenser in FIG. 9.
Figure 13:
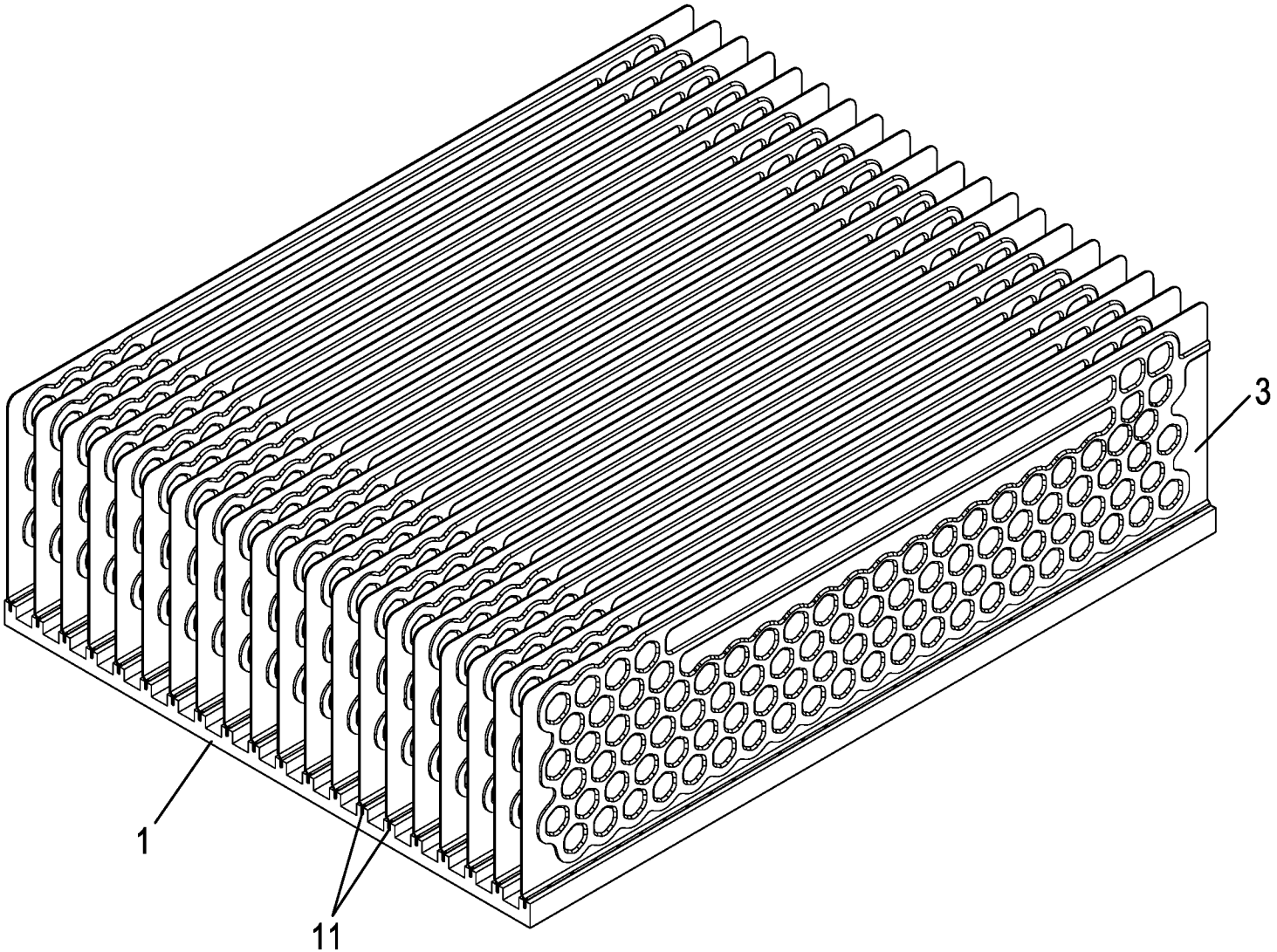
FIG. 13 is another perspective view of the double-sided roll bond condenser in FIG. 9.
Figure 14:
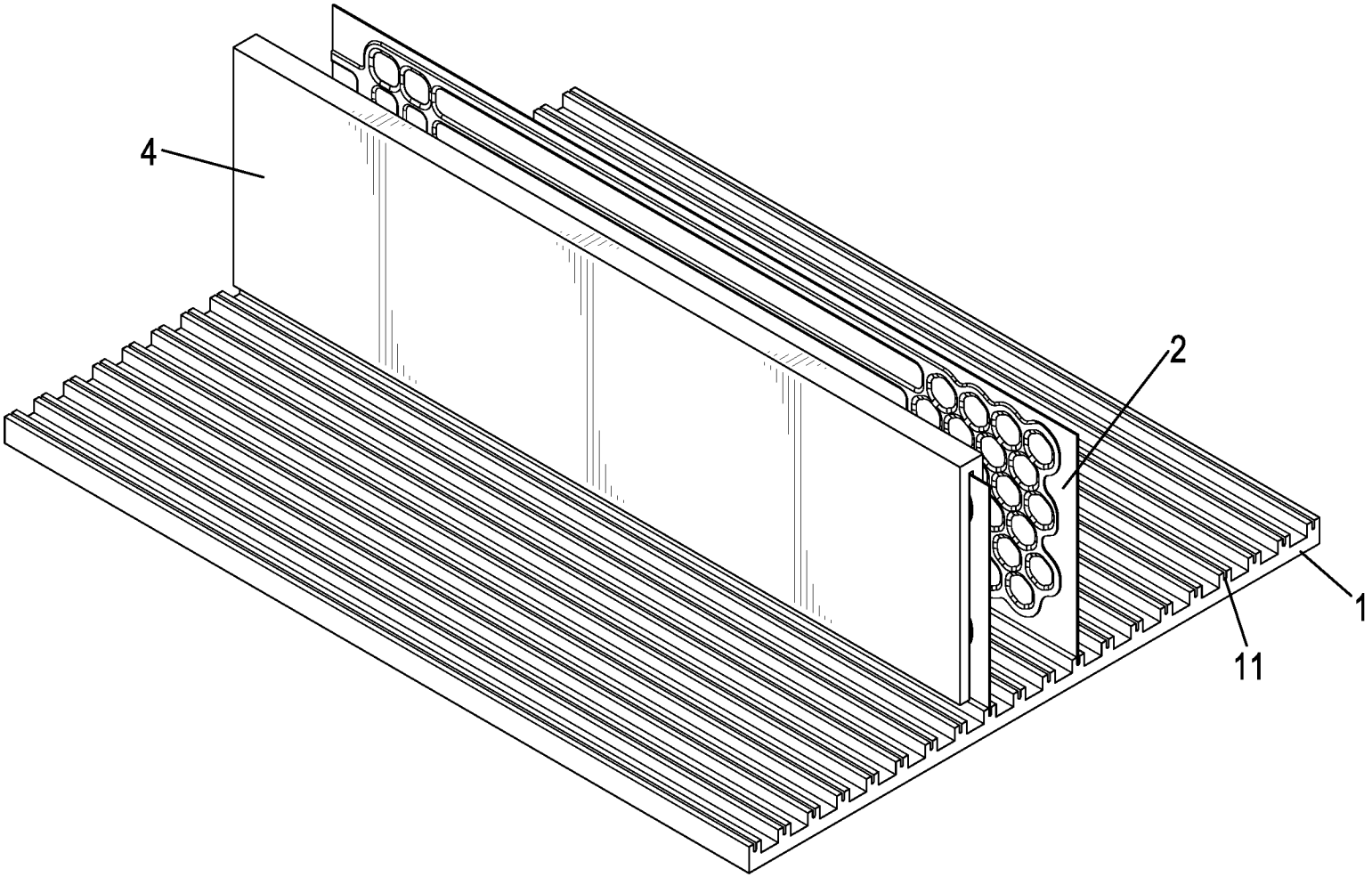
FIG.14 PRIOR ART
FIG. 14 is a perspective view of a conventional one-sided roll bond condenser.
Figure 15:
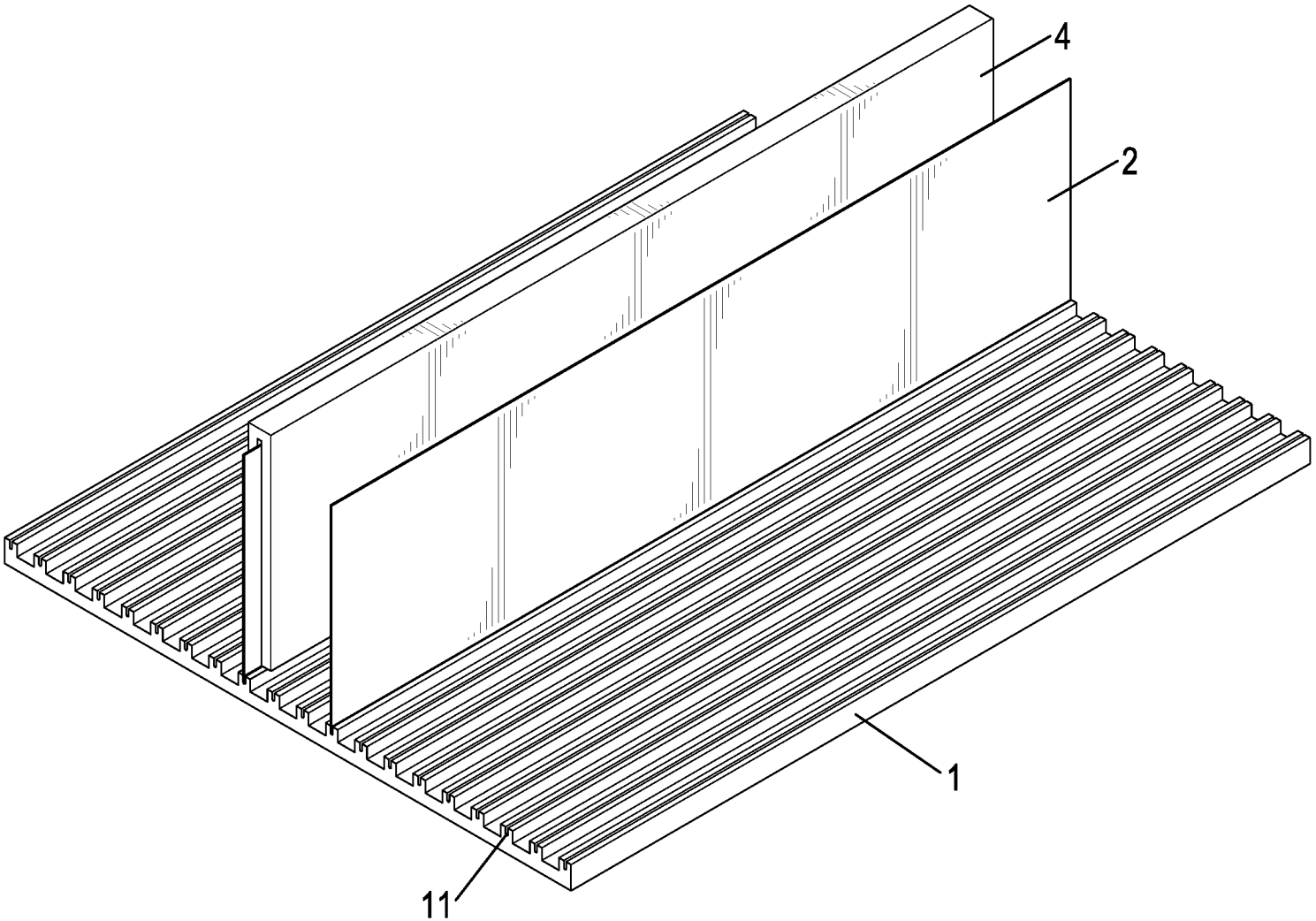
FIG.15 PRIOR ART
FIG. 15 is another perspective view of the conventional one-sided roll bond condenser.
Figure 16:
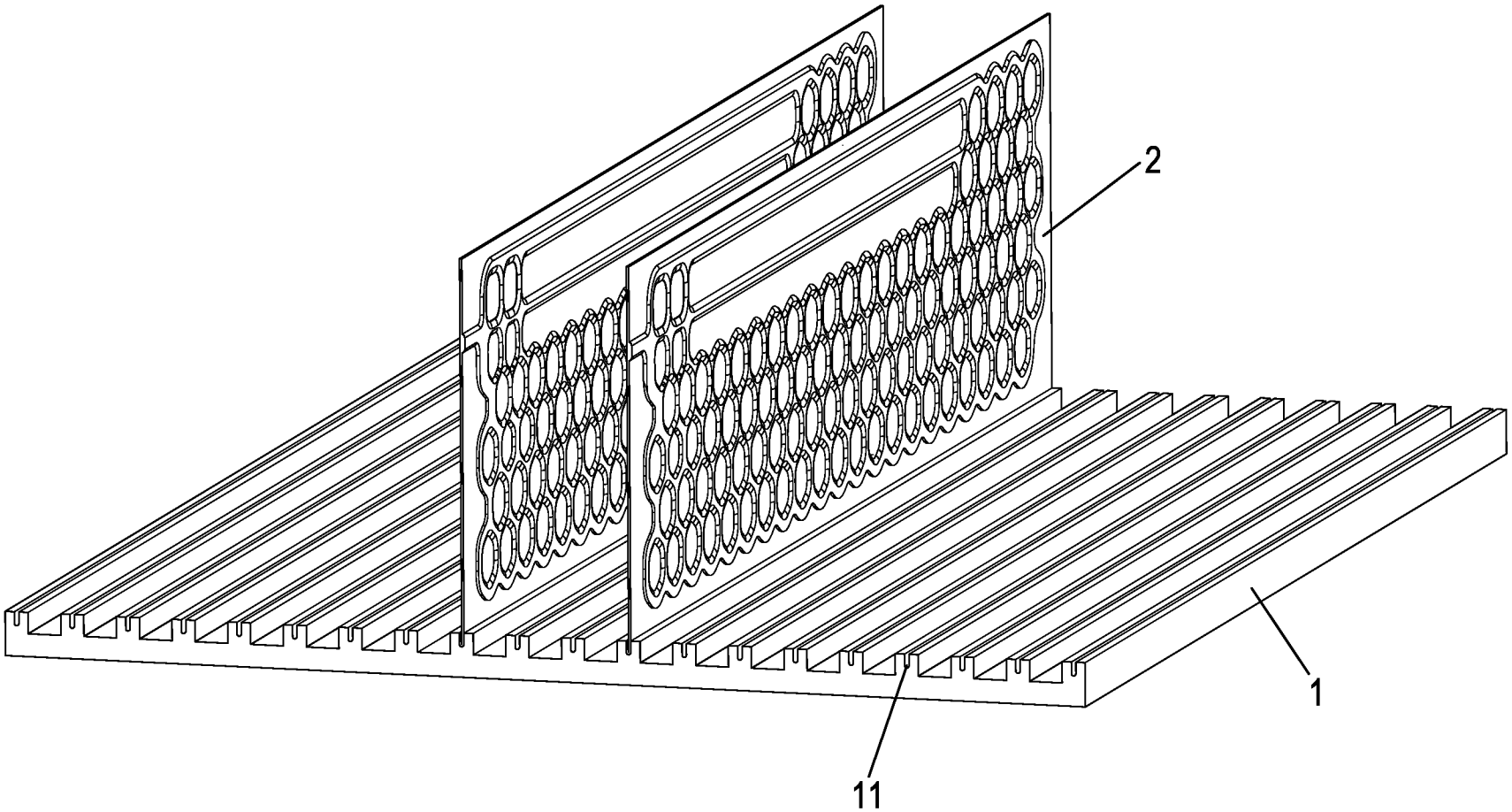
FIG.16 PRIOR ART
FIG. 16 is another perspective view of a conventional one-sided roll bond condenser.
Figure 17:
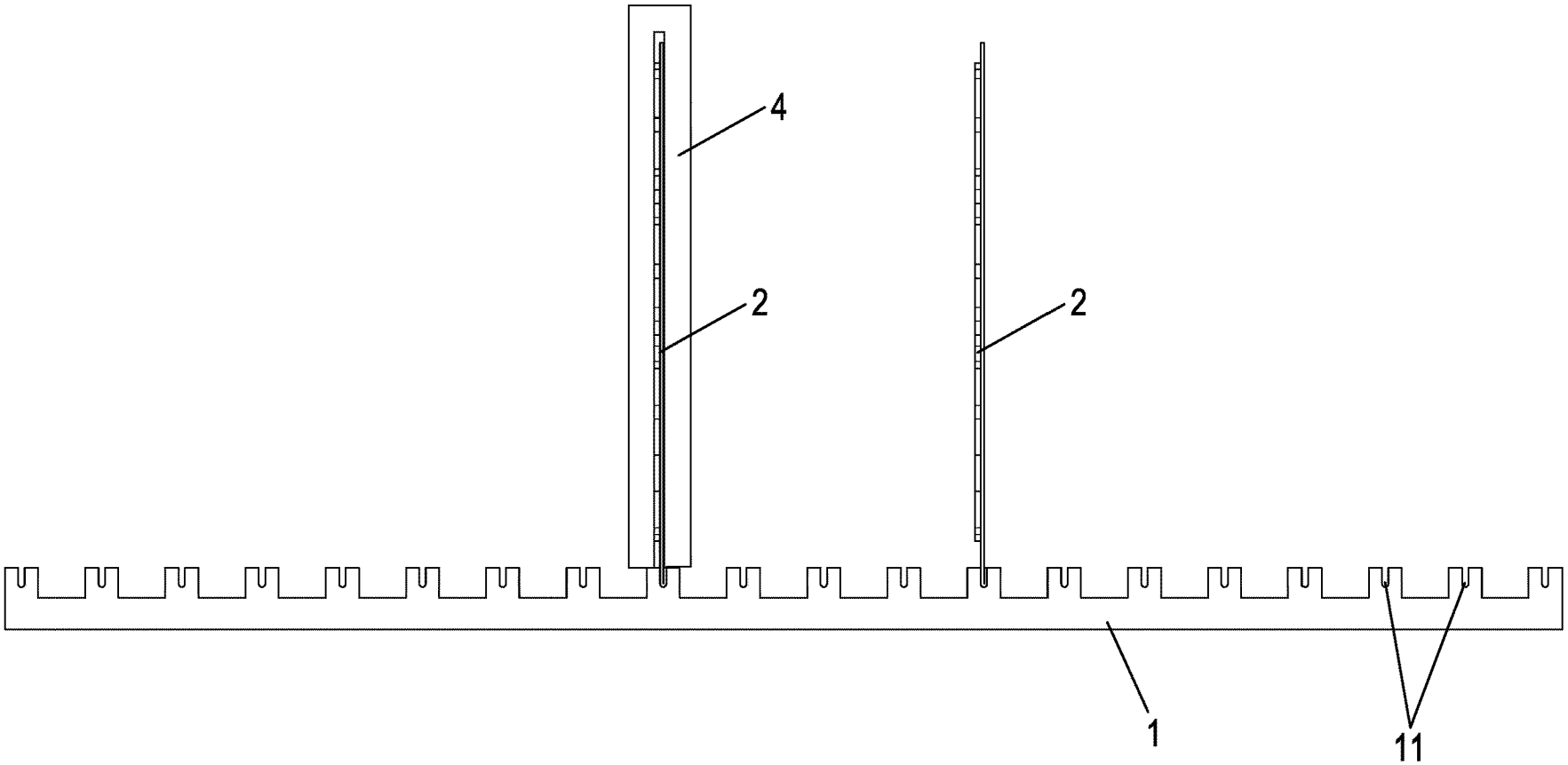
FIG.17 PRIOR ART
FIG. 17 is a front view of the conventional one sided roll bond condenser.
Figure 18:
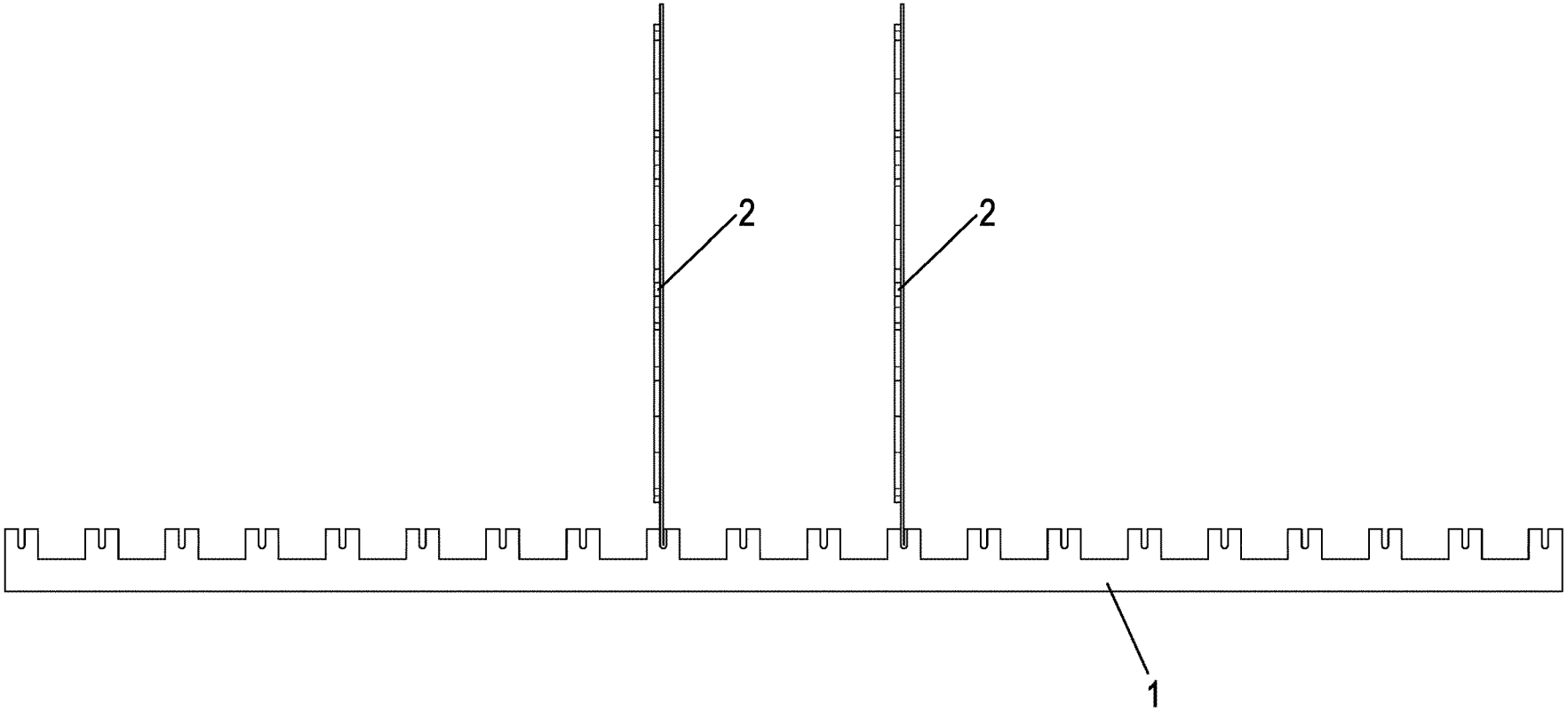
FIG.18 PRIOR ART
FIG. 18 is another front view of the conventional one sided roll bond condenser.
Figure 19:
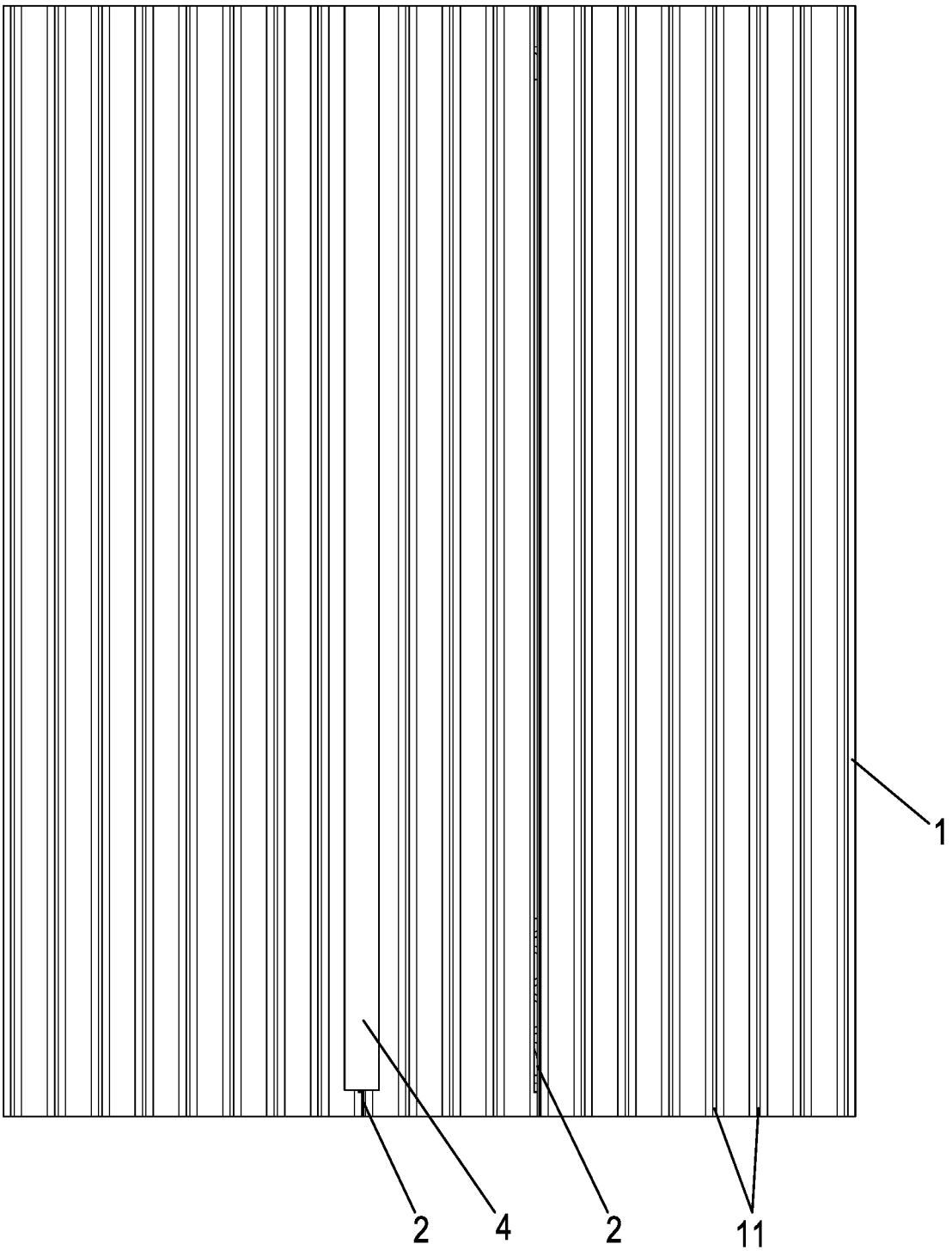
FIG.19 PRIOR ART
FIG. 19 is a top view of the conventional one sided roll bond condenser.
Figure 20:
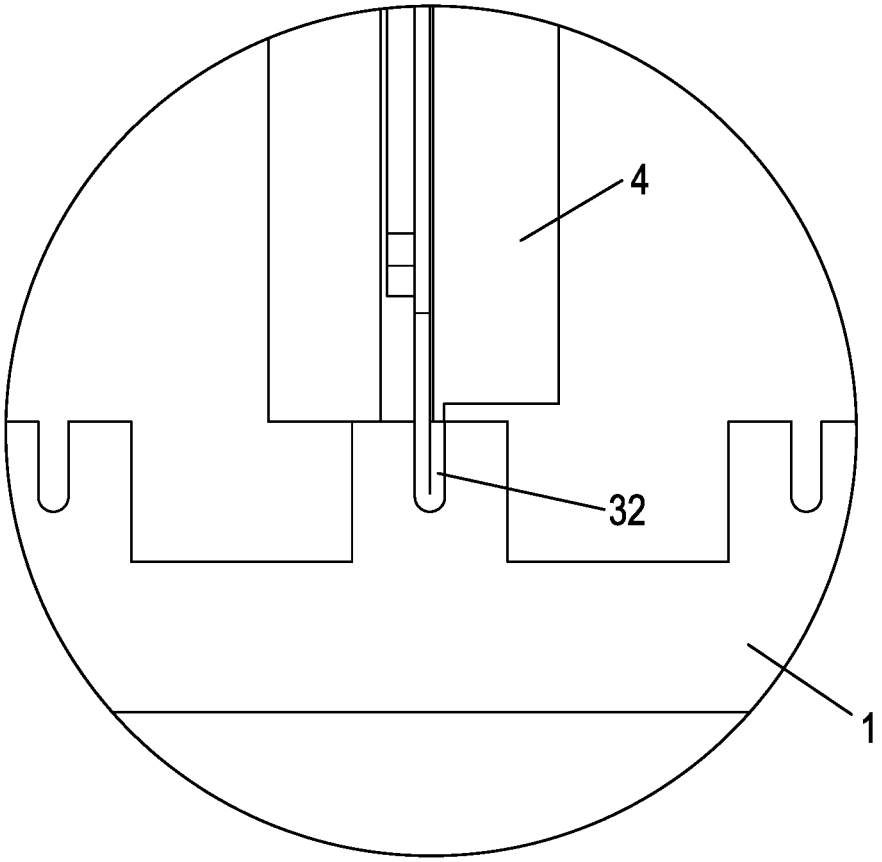
FIG.20 PRIOR ART
FIG. 20 is an enlarged front view of the conventional one sided roll bond condenser.

With reference to FIG. 10, when the double-sided roll bond condensers 3 are inserted into the mounting slots 11 of the base 1, the top surface of the second slice of the interposition section 32 of each roll bond condensers 3 protrude from the top surface of the corresponding mounting slot 11 and is served as the embedded position. An embedding tool 4 is applied to punch the top surface of the second slice of the interposition section 32. Accordingly, the top surface of the second slice of the interposition section 32 is then pressed and deformed to abut against the mounting slot 11 firmly as shown in FIG. 11, so that the double-sided roll bond condenser 3 is tightly combined with the base 1. When the roll bond condenser 3 is long, multiple punching steps have to be applied and multiple protruding tabs 321 are formed on the top surface of the second slice of the interposition section 32 and protrude from the top surface of the corresponding mounting hole 11 as shown in FIGS. 9 and 10. Specially, two side edges of the roll bond condenser 3 are clamped by clampers during the punching steps, so two protruding tabs 321 are respectively formed on two ends of the second slice of the interposition section 32 corresponding respectively to the clamped side edges of the roll bond condenser 3.

In addition, because the curved structure of the neck portion 31 is bent in a direction away from the embedded position, the filling structures 331 of the double-sided roll bond condenser 3 are further deviated from the embedded position in the direction of the top view. With the punching step, the embedded end 321 of the U-shaped folded structure is deformed to make 1 abut against the mounting slot 11 firmly, so that the double-sided roll bond condenser 3 is tightly combined with the base 1.

The embedding method of the present invention overcomes the shortcoming that the double-sided roll bond condenser 3 cannot be used for embedding in the prior art.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A double-sided roll bond condenser comprising:

a main body having two side surfaces; and two filling structures respectively formed at the two side surfaces of the main body;

an interposition section formed on a bottom portion of the double-sided roll bond condenser, and being a U-shaped folded structure; and a neck portion located between the main body and the interposition section, and having a curved structure.

2. The double-sided roll bond condenser as claimed in claim 1, wherein the curved structure of the neck portion is adjacent to an embedded position that is located at a top portion of the U-shaped folded structure.

3. The double-sided roll bond condenser as claimed in claim 2, wherein the U-shaped folded structure extends toward one of the side surfaces of the main body.

4. The double-sided roll bond condenser as claimed in claim 1, wherein the curved structure is arc-shaped.

5. The double-sided roll bond condenser as claimed in claim 1, wherein the curved structure is formed by stamping.

6. A double-sided roll bond condenser embedding structure comprising:

multiple double-sided roll bond condensers, each double-sided roll bond condenser having a main body having two side surfaces; and two filling structures respectively formed at the two side surfaces of the main body;

an interposition section located a bottom portion of the double-sided roll bond condenser, and being a U-shaped folded structure; and a neck portion located between the main body and the interposition section, and having a curved structure; and a base having multiple mounting slots formed in a top surface of the base, and the multiple mounting slots being parallel to each other, wherein the interposition sections of the multiple double-sided roll bond condensers are respectively inserted into the mounting slots of the base.

7. The double-sided roll bond condenser embedding structure as claimed in claim 6, wherein the curved structure of the neck portion is adjacent to an embedded position that is located at a top portion of the U-shaped folded structure.

8. The double-sided roll bond condenser embedding structure as claimed in claim 7, wherein each curved structure is arc-shaped.

9. The double-sided roll bond condenser embedding structure as claimed in claim 8, wherein each arc-shaped curved structure is bent toward one of the mounting slots that is adjacent to the arc-shaped curved structure.

10. The double-sided roll bond condenser embedding structure as claimed in claim 6, wherein each curved structure is formed by stamping.

11. The double-sided roll bond condenser embedding structure as claimed in claim 6, wherein the interposition section of each double-sided roll bond condenser has multiple protruding tabs protruding from a top surface of a corresponding one of the mounting slots.

12. The double-sided roll bond condenser embedding structure as claimed in claim 11, wherein the base is made of copper, aluminum, copper-based alloy or aluminum-based alloy.

13. A embedding method for a double-sided roll bond condenser, the embedding method comprising:

a first step, wherein a base is provided, and the base has multiple mounting slots formed in a top surface of the base;

a second step, wherein multiple double-side roll bond condenser s are provided, each double-side roll bond condenser has a main body, an interposition section, and a neck portion, the interposition section is formed at a bottom portion of the double-side roll bond condenser and is a U-shaped folded structure, and the neck portion is located between the main body and the interposition section;

a third step, wherein each neck portion is stamped or bent to form a curved structure; and a fourth step, wherein each interposition section is pressed into a respective one of the mounting slots.

14. The embedding method as claimed in claim 13, wherein the curved structure of the neck portion is adjacent to an embedded position that is located at a top portion of the U-shaped folded structure; and in the fourth step, the U-shaped folded structure of the interposition section of each double-sided roll bond condenser is deformed to press against a corresponding one of the mounting slots to tightly combine the double-sided roll bond condenser with the base.

15. The embedding method as claimed in claim 14, wherein each curved structure is arc-shaped.

16. The embedding method as claimed in claim 15, wherein the arc-shaped curved structure is bent toward one of the mounting slots that is adjacent to the arc-shaped curved structure.

17. The embedding method as claimed in claim 13, wherein the U-shaped folded structure extends toward one side surface of the main body.

* * * * *